US011148913B2

(12) United States Patent
Hallot et al.

(10) Patent No.: US 11,148,913 B2
(45) Date of Patent: Oct. 19, 2021

(54) DEVICE AND METHOD FOR INSTALLING AND HANDLING A MODULE OF A SUBSEA TREATMENT STATION

(71) Applicant: SAIPEM S.A., Montigny le Bretonneux (FR)

(72) Inventors: Raymond Hallot, Voisins le Bretonneux (FR); Fabrice Bacati, Rueil Malmaison (FR); Thomas Delaplace, Clichy (FR)

(73) Assignee: SAIPEM S.A., Montigny le Bretonneux (FR)

( * ) Notice: Subject to any disclaimer, the term of this patent is extended or adjusted under 35 U.S.C. 154(b) by 0 days.

(21) Appl. No.: 16/961,791

(22) PCT Filed: Jan. 15, 2019

(86) PCT No.: PCT/FR2019/050076

§ 371 (c)(1),
(2) Date: Jul. 13, 2020

(87) PCT Pub. No.: WO2019/141933

PCT Pub. Date: Jul. 25, 2019

(65) Prior Publication Data

US 2021/0070588 A1 Mar. 11, 2021

(30) Foreign Application Priority Data

Jan. 18, 2018 (FR) ..... 18 50415

(51) Int. Cl.
*B66C 1/66* (2006.01)
*B66C 1/10* (2006.01)
*B63B 27/36* (2006.01)

(52) U.S. Cl.
CPC ..... *B66C 1/663* (2013.01); *B66C 1/101* (2013.01); *B63B 27/36* (2013.01)

(58) Field of Classification Search
CPC ..... B66C 1/00; B66C 1/663; B66C 1/101; B63B 27/00; B63B 27/36; B63B 21/00;
(Continued)

(56) References Cited

U.S. PATENT DOCUMENTS 4,537,533 A * 8/1985 Hampton ..... B63B 21/502 405/205
6,120,009 A * 9/2000 Gatehouse ..... F16F 5/00 267/64.11

(Continued)

FOREIGN PATENT DOCUMENTS

CN 104444756 A 3/2015
DE 102009015971 A1 10/2010

(Continued)

OTHER PUBLICATIONS

Search Report from corresponding FR Application No. FR1850415, dated Oct. 1, 2018.

(Continued)

*Primary Examiner* — Lars A Olson
(74) *Attorney, Agent, or Firm* — Workman Nydegger

(57) ABSTRACT

A device for installing and handling a module of a subsea processing station, comprises a frame, and a hydraulic system comprising hydraulic cylinders each comprising a cylinder body, and a piston intended to be put into contact with a foot and movable inside the cylinder body between a first mechanical abutment corresponding to a deployed position of the piston and a second mechanical abutment corresponding to a retracted position of the piston. The piston divides the internal volume of the cylinder body into a first chamber and a second chamber. The first chamber is supplied with hydraulic fluid by two independent hydraulic circuits comprising a shock-absorbing circuit able to move the piston between the deployed and intermediate positions located between the deployed position and the retracted (Continued)

position defined by a hydraulic abutment, and a controlled-lowering circuit able to move the piston between the intermediate position and its retracted position.

15 Claims, 4 Drawing Sheets

(58) Field of Classification Search
CPC ..... B63B 21/50; B63B 21/502; B63B 35/00; B63B 35/40; B63C 11/00; B63C 11/44; F16F 5/00
USPC ..... 114/51
See application file for complete search history.

(56) References Cited

U.S. PATENT DOCUMENTS

| | | | | |
|---|---|---|---|---|
| 9,650,855 | B2 * | 5/2017 | Caldwell | E21B 33/038 |
| 10,295,007 | B2 * | 5/2019 | McIntosh | B63B 21/502 |

FOREIGN PATENT DOCUMENTS

| | | | |
|---|---|---|---|
| GB | 2496608 | A | 5/2013 |
| JP | 2007246177 | A | 9/2007 |
| KR | 20030059941 | A | 7/2003 |
| WO | 2011099867 | A1 | 8/2011 |

OTHER PUBLICATIONS

International Search Report and Written Opinion from PCT Application No. PCT/FR2019/050076, dated Apr. 9, 2019.

* cited by examiner

DEVICE AND METHOD FOR INSTALLING AND HANDLING A MODULE OF A SUBSEA TREATMENT STATION

BACKGROUND OF THE INVENTION

The present invention relates to the general field of the subsea processing of fluids involved in the production of hydrocarbons, for example oil and gas, or the exploitation of mineral resources at great depths derived from subsea production wells.

In the context of the production of hydrocarbons, it is generally necessary to proceed with the processing of the production effluents and/or injection fluids (such as, for example, seawater). For this purpose, it is known to use subsea processing stations, called "subsea processing", in which the fluids are processed in equipment placed directly on the seabed instead of being located on the platforms of production as it is usually the case. These subsea processing stations have many economic advantages, in particular in that they make it possible to avoid having to convey the fluids to the surface. More generally, these subsea processing stations can help unblocking the exploitation of new fields that were previously difficult to exploit.

However, this subsea processing solution poses some problems. Particularly, these stations may require interventions for maintenance operations for which it is then necessary to raise equipment from the station to the surface. In order to allow carrying out these maintenance operations using conventional maintenance boats and not having to use field development boats which are expensive and not very available, it may be necessary to subdivide the subsea processing stations in several subsets called "modules" each containing part of the equipment of the station. In this way, each of these modules is sufficiently light to be raised to the surface by means of a conventional intervention and maintenance boat.

With this solution, the architecture of the processing station typically consists of a structural base on which the various modules are laid and connected. The assembly formed by the base and the modules constitutes the complete processing station. It is also necessary to connect the modules with each other and/or with the structural base if the fluids to be processed pass therethrough between the different modules (the structural base of the station is then called "flowbase"), these connections being made by means of vertical or horizontal connectors.

The installation of a module on the structural base of such a subsea processing station is generally carried out by means of a winch of the maintenance boat which ensures the lowering of the module towards the seabed. During this installation, it is necessary to avoid excessive impacts so as not to damage the modules and the base. In the context of a vertical connection (for the transit of the fluids), this risk is even greater. Indeed, upon impact, the faces or other elements of the vertical connectors of the module and of the structural base could be damaged, which would require replacing these critical and expensive elements in order to prevent any leakage of effluents into the sea during the exploitation of the processing station. In addition, the landing speed on the base of the subsea processing station (called "flowbase") of the module is highly dependent on the states of the sea on the surface during the installation and the dynamics of the system is amplified with the installation depth.

In order to reduce the impact of the modules upon their landing on the base of the subsea processing station, it is known to use systems directly installed on the winches of the maintenance boats making it possible to decouple the movements of the module, during the lowering, from the surface movements of the boat. However, these decoupling systems have their limits and can be faulty.

Another known solution for absorbing the impact of the modules of a station upon their landing on the base of the station consists in placing shock-absorbers under the module during its landing, these shock-absorbers being in the form of hydraulic cylinders supplied by surrounding seawater. When the module lands, the feet of these shock-absorbers (which are formed by the rod of the cylinders) return to their chamber, expelling the seawater outwards. To exit, the seawater passes through orifices of specific sizes and the landing energy of the module is dissipated via the pressure drop of the water exiting the chamber when the rods of the cylinders sink.

This solution, which is functional and relatively effective in absorbing the impact of the module during its landing, has however some drawbacks. In particular, in the case of vertical connectors, these shock-absorbers do not prevent the impact between two faces of the vertical connectors, they only slow it down. As a result, the final impact speed is not perfectly controlled and depends on the movements of the surface maintenance boat (which dictate the initial impact speed). In addition, if there is a difference in shock-absorption between several cylinders, this leads to inducing an imbalance of the module during landing since each of the shock-absorbers operates independently. In addition, these shock-absorbers are sized and installed for each particular module, making them difficult (even impossible) to be reused for other modules. Finally, the maintenance operations on the connectors (change of seal for example) are dependent on the winch of the boat and therefore on its movements due to the swell. The module must indeed be raised using the winch such that the underwater intervention robot(s) (called ROV for Remote Operated Vehicles) can intervene on the connectors. These operations therefore induce a repetition of the risk for the vertical connectors.

OBJECT AND SUMMARY OF THE INVENTION

The present invention therefore aims mainly at proposing a device for installing and maintaining a module of a subsea processing station which does not have the aforementioned drawbacks.

According to the invention, this aim is achieved by means of a device for installing and handling a module of a subsea processing station, comprising a frame intended to be fixed to a module, and a hydraulic system intended to ensure a shock-absorption and a controlled-lowering of the module on the base of the station, the hydraulic system comprising a plurality of hydraulic cylinders each intended to be connected to a foot able to come into contact with a base of the subsea processing station, each hydraulic cylinder comprising:

- a cylinder body secured to the frame; and
- a piston intended to be put into contact with a foot and movable in translation inside the cylinder body between a first mechanical abutment corresponding to a deployed position of the piston and a second mechanical abutment corresponding to a retracted position of the piston, the piston dividing the internal volume of the cylinder body into a first chamber and a second chamber which are sealed relative to each other;
- the first chamber of each hydraulic cylinder being supplied with hydraulic fluid by two independent hydraulic circuits comprising a shock-absorbing circuit able to move the piston between its deployed position and an intermediate position located between the deployed position and the retracted position and defined by a hydraulic abutment, and a controlled-lowering circuit able to move the piston between the intermediate position and its retracted position.

The hydraulic system of the device according to the invention comprises hydraulic cylinders fixed to the frame and whose piston is put into contact or connected with the feet and having two functions: a function for absorbing the impacts upon landing of the module on the base of the station during which the piston moves between its deployed position (first mechanical abutment) and its intermediate position (hydraulic abutment), and a controlled-lowering function in which the piston can move between its intermediate position and its retracted position (second mechanical abutment). These functions are implemented by means of two independent hydraulic circuits, namely a shock-absorbing circuit and a controlled-lowering circuit for all of the hydraulic cylinders.

The device according to the invention is thus remarkable in particular in that it provides a decoupling between the shock-absorbing stroke and the controlled-lowering stroke of the pistons of the hydraulic cylinders unlike the shock-absorbing devices of the prior art in which these two phases are implemented at the same time. In this way, the shock-absorption during the landing of the module is carried out without risk of contact between the faces of the vertical connectors, regardless of the number of impacts. The lowering into the final position of the module is carried out independently of the movements of the installation and maintenance boat and can therefore be perfectly controlled. The device according to the invention thus allows minimizing the risks linked to the installation of modules equipped with vertical connectors. In addition, the use of the multi-stage hydraulic cylinders allows implementing these functions in a compact and lightest possible manner.

In addition, the device according to the invention can allow raising the module to carry out maintenance operations on the connectors (seal change for example) without using the winch of the maintenance boat. Finally, unlike the shock-absorbing devices of the prior art, the device according to the invention can be retrieved on the surface after the installation of a module, which allows carrying out its maintenance for the next operation.

The piston of each hydraulic cylinder may have, at one end located inside the body of the cylinder, an opening communicating with the first chamber and a flange coming into sealed contact with an inner wall of the body of the cylinder.

In this case, the cylinder body of each hydraulic cylinder may be equipped with a finger protruding inside the first chamber, the finger having an external diameter corresponding substantially to the internal diameter of the piston so as to cooperate with the opening of the piston to form the hydraulic abutment corresponding to the intermediate position of the piston. The finger advantageously comprises a discharge duct of the hydraulic controlled-lowering circuit which opens out inside the piston when the latter is in the intermediate position so as to allow moving the piston between the intermediate position and the retracted position.

Furthermore, the inside of the cylinder body of each hydraulic cylinder may comprise bearing surfaces against which the flange of the piston is able to come into contact to form the first and the second mechanical abutment.

Each hydraulic cylinder may further comprise a guide rod connecting the finger to the piston and a spring mounted around the guide rod to assist in the deployment of the piston.

The second chamber of each hydraulic cylinder can be supplied with hydraulic fluid by a hydraulic raising circuit. In this case, the hydraulic raising circuit of each hydraulic cylinder may comprise grooves formed in an outer wall of the piston which open outside the device and open out into the second chamber.

Preferably, the shock-absorbing and controlled-lowering circuits each comprise a valve which is able to be piloted by a remote operated vehicle from the surface, and a check valve in parallel with the valve to allow increasing the incoming fluid flow rate upon deployment of the cylinders.

Also preferably, the shock-absorbing and controlled-lowering circuits each comprise at least one pressure relief valve downstream of the hydraulic cylinders. The shock-absorbing and controlled-lowering circuits can be supplied with seawater.

The object of the invention is also a method for installing and handling a module of a subsea processing station, wherein the frame of a device as defined above is attached to a module, the method comprising, during the phases of lowering and landing the module on a base of the subsea processing station, the steps of:

deploying the respective pistons of the hydraulic cylinders of the device, opening the shock-absorbing circuit and closing the controlled-lowering circuit to absorb the impacts of the module on the base of the station; and once the module has landed on the base of the station, opening the controlled-lowering circuit by keeping the shock-absorbing circuit open to allow the final lowering of the station of the module on the base of the station.

Preferably, the method further comprises, during a phase of lifting the module, a step of pumping the fluid to inject it into the shock-absorbing and controlled-lowering circuits to deploy the respective pistons of the hydraulic cylinders of the device.

Also preferably, the method further comprises, during a phase of retrieving the device on the surface after installation of the module on the base of the subsea processing station, the closing of the controlled-lowering circuit and the opening of mechanical connections between the device and the module in order to lift the device on the surface using a winch from an installation and maintenance boat.

Still preferably, the method further comprises a phase of retrieving the module on the surface with the device retrieved on the surface, the retrieval phase comprising the steps of:

lowering the device under water from the surface by the installation and handling boat, to the module;

mechanically fixing the device to the module;

closing the valve of the controlled-lowering circuit;

pumping the fluid to inject it into the shock-absorbing and controlled-lowering circuits to deploy the respective pistons of the hydraulic cylinders of the device and raise the module in the intermediate position, on the hydraulic abutment; and retrieving the module and the device using the winch of the installation and maintenance boat.

BRIEF DESCRIPTION OF THE DRAWINGS

Other characteristics and advantages of the present invention will emerge from the description given below, with reference to the appended drawings which illustrate exemplary embodiments thereof without any limitation. In the figures.

DETAILED DESCRIPTION OF THE INVENTION

The invention applies to the maintenance of modules making up a subsea processing station used in the context of the production of hydrocarbons or the exploitation of mineral resources at great depths for the processing of production effluents and/or injection fluids (such as seawater).

Figure 1:
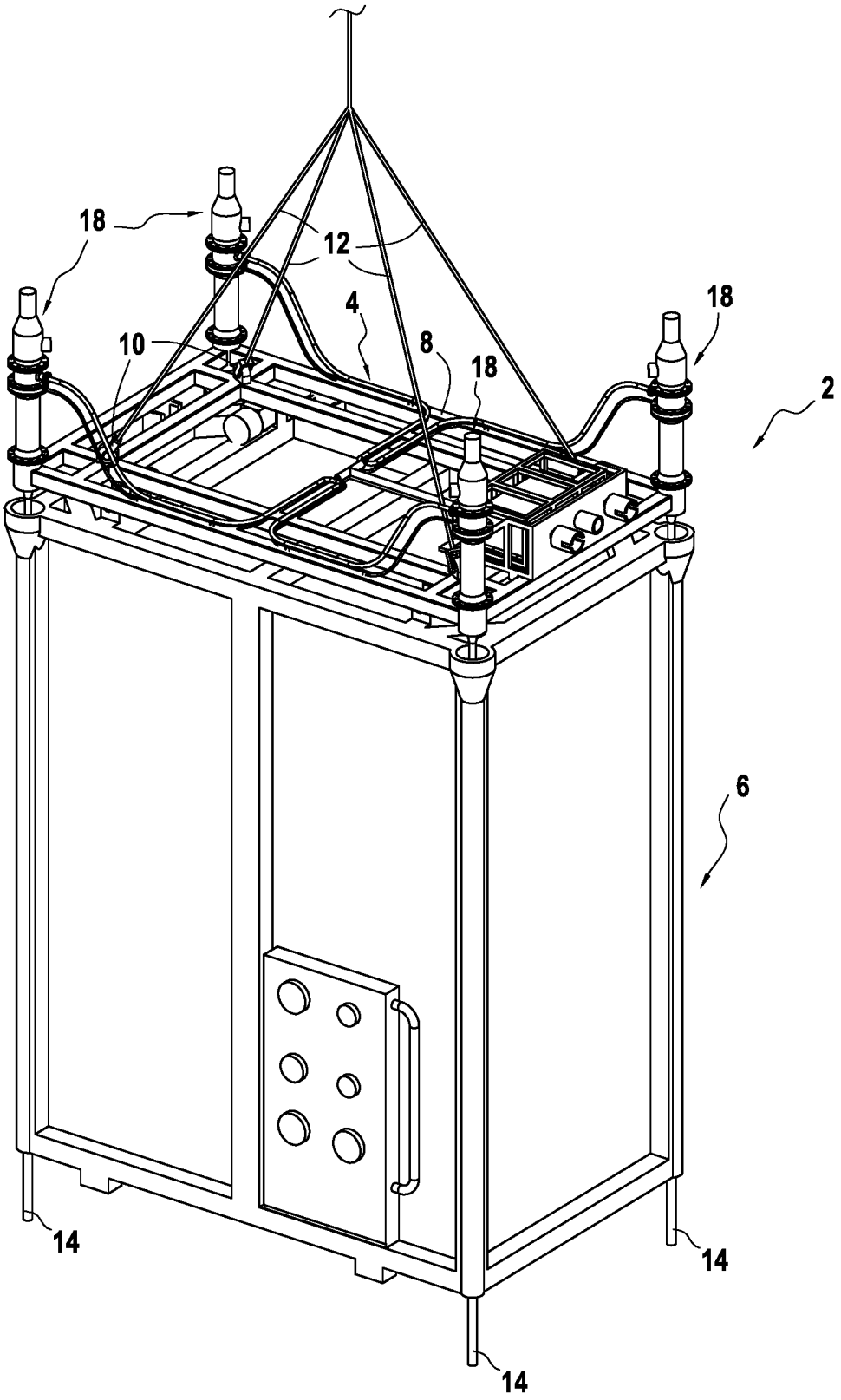
FIG. 1 is a perspective view of a device according to the invention mounted on a module of a subsea processing station.

FIG. 1 represents a device 2 according to a (non-limiting) embodiment of the invention which is used to carry out such maintenance.

The device 2 according to the invention comprises a frame 4 which is intended to be fixed (temporarily or permanently) on the upper face of a module 6 of the subsea processing station.

More specifically, the frame 4 of the device comprises a structure 8, for example of rectangular shape, on which module-fixing devices are mounted and on which fasteners 10 are also mounted to allow fixing the slings 12 attached to the end of a cable driven by a winch of the maintenance boat.

The module 6 of the subsea processing station comprises feet 14 (four in number) that slide in sheaths (here integrated into the module but which can alternatively be integrated into the frame of the device) and which are intended to come in contact with the base of the subsea processing station (called "flowbase") upon landing of the module. In this way, the vertical forces exerted on the feet 14 by the base of the station upon landing of the module are transmitted to the pistons of the cylinders.

The frame 4 of the device also comprises a hydraulic system 16 which is intended to ensure a shock-absorbing and a controlled-lowering of the module on the base of the station.

This hydraulic system 16 comprises a plurality of hydraulic cylinders 18 which are each intended to be connected to one of the feet 14 of the module. Thus, in the exemplary embodiment of FIG. 1, the hydraulic system comprises four hydraulic cylinders 18 positioned at the four corners of the structure 8 of the frame, these cylinders being in contact with the feet 14 that slide through the sheaths along the module.

Figure 2:
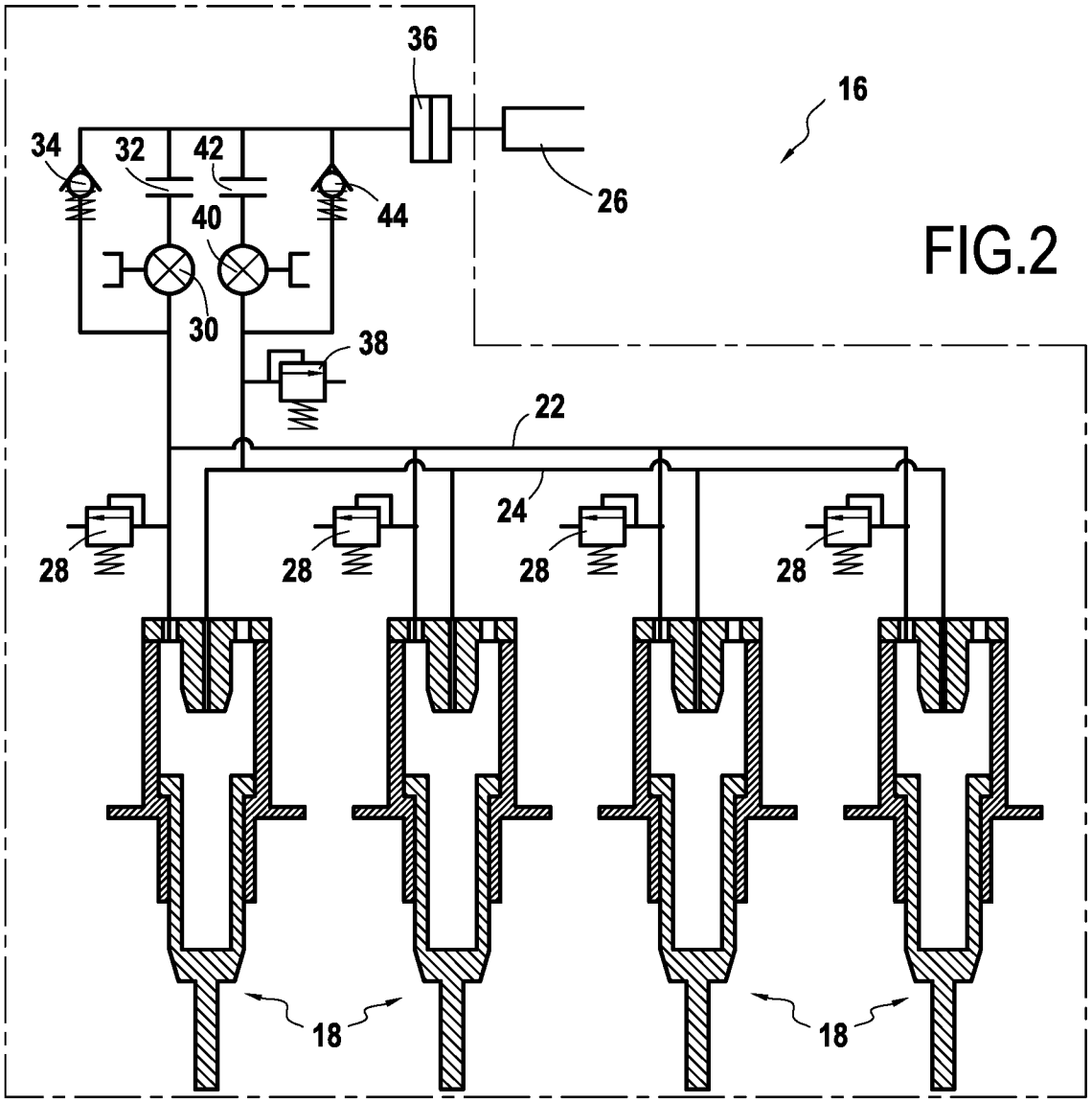
FIG. 2 illustrates an example of architecture of hydraulic circuits of the device of FIG. 1.

FIG. 2 represents an example of architecture of the hydraulic system 16 equipping the device according to the invention.

As indicated previously, this hydraulic system 16 comprises four hydraulic cylinders 18. These hydraulic cylinders are double-stage cylinders which are supplied with fluid (typically seawater) by two independent hydraulic circuits, namely the same shock-absorbing circuit 22 (for all the cylinders) and the same controlled-lowering circuit 24 (for all the cylinders).

The shock-absorbing circuit 22 comprises, downstream of each hydraulic cylinder (in the direction of flow of the fluid towards a common exhaust 26), a pressure relief valve 28. These valves have in particular the function of limiting the pressure in the chambers of the hydraulic cylinders by releasing only the required fluid flow rate. This allows obtaining a shock-absorbing force of the cylinders (directly linked to the pressure in the chambers of the cylinders) which is constant at the beginning of the shock-absorption phase and thus avoiding any excessively sudden deceleration at the start. Of course, this function could be obtained thanks to the same pressure relief valve common to all of the hydraulic cylinders of the shock-absorbing circuit.

The shock-absorbing circuit 22 also comprises, downstream of the pressure relief valves 28, a valve 30 which is common to all of the hydraulic cylinders and which is able to be piloted by a remote operated vehicle (ROV), not represented in the figures) from the surface. The piloting of this valve 30 will be detailed later.

Downstream of the valve 30, the shock-absorbing circuit 22 also comprises a restriction orifice 32 which allows defining the profile of the device shock-absorption phase. More specifically, this restriction orifice 32 is calibrated to control the shock-absorption desired and therefore the final impact speed.

A check valve 34 is also added in the shock-absorbing circuit in parallel with the valve 30 and with the restriction orifice 32 to allow increasing the fluid flow rate entering the chambers upon deployment of the cylinders (device resetting phase).

Downstream, the shock-absorbing circuit 22 ends with an exhaust 26 which is common with the controlled-lowering circuit 24. A filter 36 can be added upstream of the common exhaust 26 in order to prevent the introduction of solid particles or organisms in the hydraulic circuits.

The controlled-lowering circuit 24 comprises, downstream of the four hydraulic cylinders, a pressure relief valve 38. This valve is common for all of the hydraulic cylinders and allows increasing the safety of the device in the event of an accidental pressure rise in the controlled-lowering circuit.

The controlled-lowering circuit 24 also comprises, downstream of the pressure relief valve 38, a valve 40 which is common to all of the hydraulic cylinders and which is able to be piloted by the remote operated vehicle from the surface. The piloting of this valve 40 will be detailed later.

Downstream of the valve 40, the controlled-lowering circuit also comprises a restriction orifice 42 which allows controlling the exhaust flow rate of the controlled-lowering circuit and therefore the lowering speed of the module during the phase of lowering the device.

A check valve 44 is also added in the controlled-lowering circuit in parallel with the valve 40 and with the restriction orifice 42 to allow increasing the fluid return flow rate and assisting in the exiting of the cylinders by decreasing the hydraulic pressure drops.

In relation to FIGS. 3, 5 and 6, exemplary embodiments of a hydraulic cylinder 18 fitted to the hydraulic system 16 of the device according to the invention will now be described.

Each hydraulic cylinder 18 of the hydraulic system 16 of the device according to the invention is a double-stage cylinder. It comprises in particular a cylinder body 46 which is secured (temporarily or permanently) to the frame of the device, and a piston 48 whose free end 50 is intended to be put into contact (by being connected or by simple bearing) with one of the feet of the module.

The piston 48 is movable inside the cylinder body 46 and divides the internal volume of the cylinder body into a first chamber 52 and a second chamber (see FIGS. 4B to 4D) which are sealed relative to each other.

At its end located inside the body of the cylinder (opposite its free end 50), the piston 48 has an opening 56 which communicates with the lowering chamber 52, as well as a flange 58 which comes into sealed contact with an inner wall of the cylinder body upon displacement of the piston thereinside.

Upon displacement of the piston 48 inside the body of the cylinder, the flange 58 is able to come into mechanical abutment against the bearing surfaces arranged in the body of the cylinder.

Figure 3:
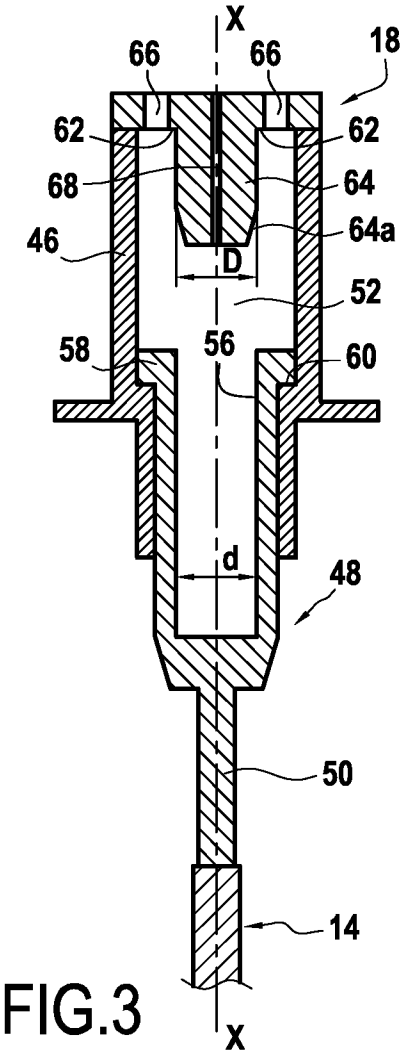
FIG. 3 shows schematically an exemplary embodiment of a hydraulic cylinder of the device of FIG. 1.
Figure 4A:
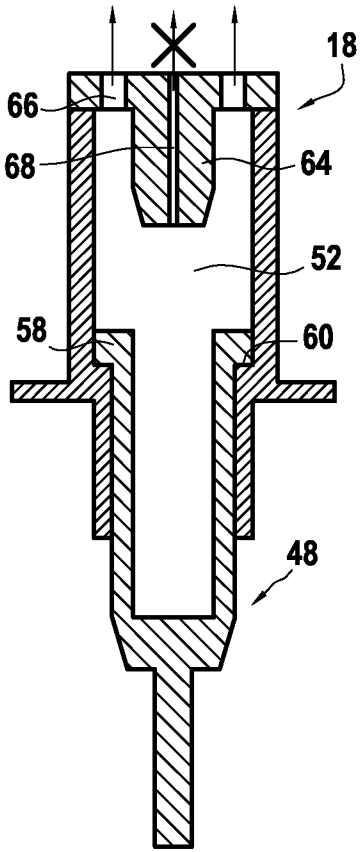
FIGS. 4A to 4D show the different positions of the cylinder of FIG. 3 according to the functions of the device.
Figure 4B:
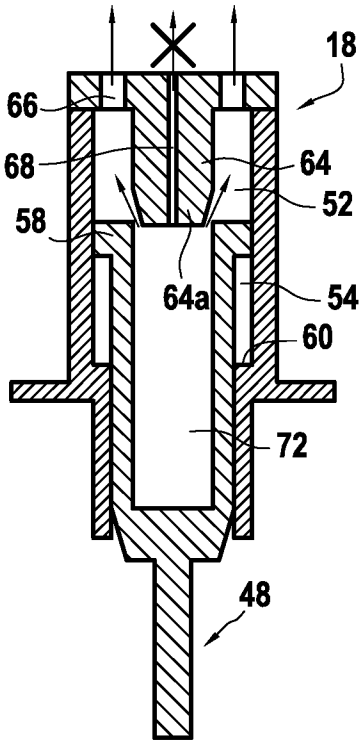

More specifically, in its lower part, the cylinder body comprises a lower bearing surface 60 against which the flange 58 of the piston comes into contact to form a first mechanical abutment corresponding to a deployed position of the piston (in the case of FIGS. 3 and 4A).

Figure 4C:
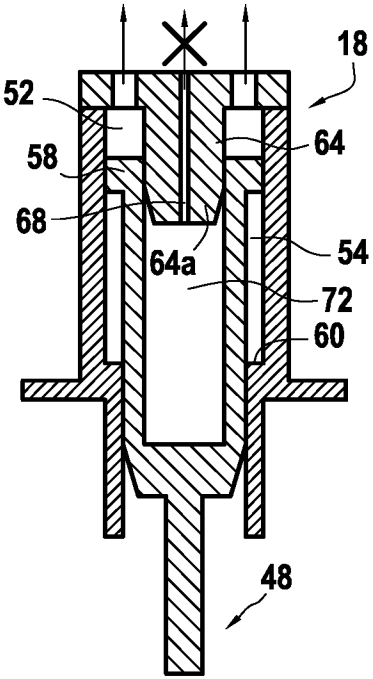
Figure 4D:
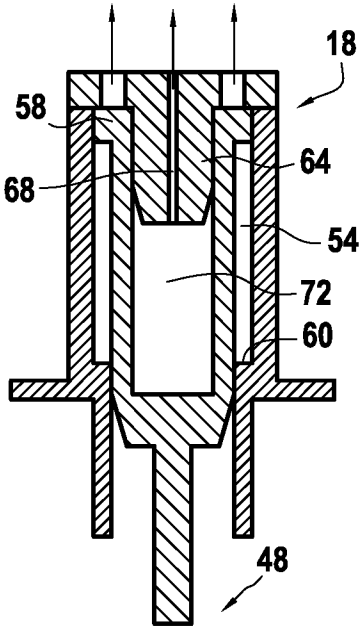

In its opposite upper part, the cylinder body comprises an upper bearing surface 62 against which the flange 58 of the piston comes into contact to form a second mechanical abutment corresponding to a retracted position of the piston (case of FIG. 4D).

Furthermore, the cylinder body 46 of the hydraulic cylinder is here substantially cylindrical and it is provided with a cylindrical finger 64 protruding inside the first chamber 52.

This finger is centered on an axis of revolution X-X of the cylinder and has an external diameter D which is substantially equal to the internal diameter d of the opening 56 formed at the end of the piston 48. It allows defining a hydraulic abutment of the piston corresponding to an intermediate position of the piston located between the deployed position and the retracted position.

As detailed above, each hydraulic cylinder 18 of the hydraulic system of the device according to the invention is supplied with fluid by the shock-absorbing circuit 22 and the controlled-lowering circuit 24.

To this end, the body of the cylinder 46 has, at its upper bearing surface 62, one or several discharge duct(s) 66 opening into the lowering chamber 52 and opening out towards the shock-absorbing circuit 22 described above. The shock-absorbing circuit allows moving the piston of the cylinder between the first mechanical abutment and the hydraulic abutment.

Likewise, at the finger 64, the cylinder body comprises a discharge duct 68 opening into the first chamber 52 and opening out towards the controlled-lowering circuit 24. The controlled-lowering circuit allows moving the piston between the hydraulic abutment and the second mechanical abutment.

In relation to FIGS. 4A to 4D, the operation of the device according to the invention will now be described.

Upon installation of a module of the subsea processing station, it is necessary to lower it towards the seabed. To this end, the device according to the invention is mounted on the module and connected to the installation and maintenance boat on the surface via the cable of a winch. The winch unwinds the cable to lower the module towards the base of the subsea processing station.

Figure 6:
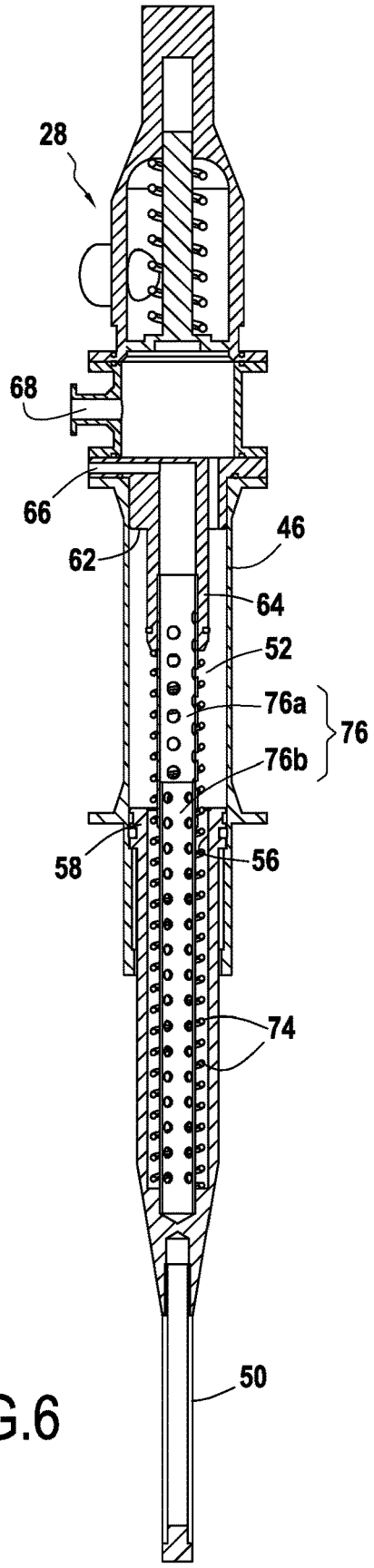
FIG. 6 is a sectional view along VI-VI of FIG. 5.

During this phase of lowering and landing the module on the base of the station, the respective pistons 48 of the hydraulic cylinders 18 of the device are in the deployed position as represented in FIGS. 3, 4A and 6 (the flange 58 of the piston comes in contact against the lower bearing surface 60 of the cylinder body).

In addition, before the lowering of the module, the valve 30 of the shock-absorbing circuit 22 is open and the valve 40 of the controlled-lowering circuit is closed on the surface on board the installation and maintenance boat in order to absorb the impacts of the module on the base of the station, in particular due to the swell which can generate several ones.

Upon impact of the feet of the module on the base of the station, the energy of the module in movement pushes on the feet mechanically connected to the free end 50 of the pistons of the hydraulic cylinders. This has the effect of expelling the water present in the first chamber 52 towards the shock-absorbing circuit by taking the discharge ducts 66 as the piston retracts inside the body of the cylinder.

Figure 5:
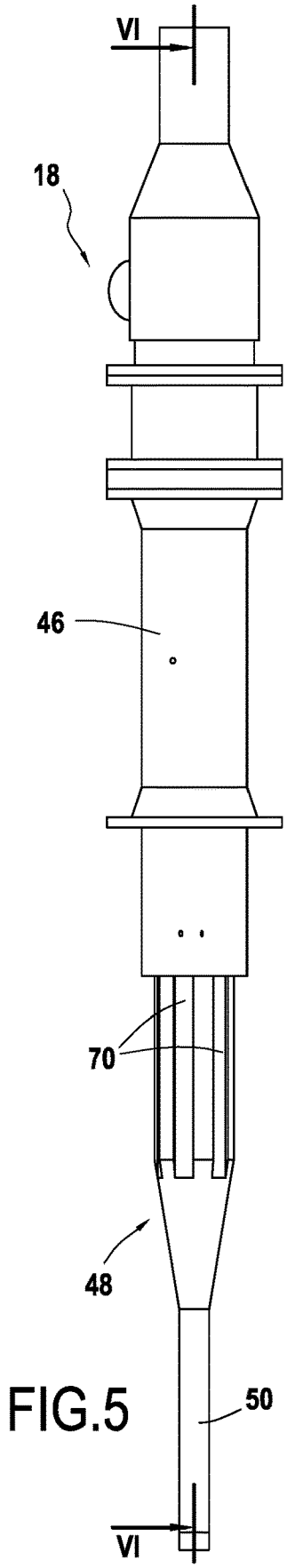
FIG. 5 is a perspective view of a hydraulic cylinder of the device according to an alternative embodiment of the invention.

At the same time, during this shock-absorption phase, the second chamber 54 is filled with seawater, for example by passing through grooves 70 formed in an outer wall of the piston which open to the outside of the device and which open out into the second chamber (see FIG. 5).

The end of the shock-absorption phase is defined by the moment when the finger 64 of the body of the cylinder plugs the opening 56 of the piston (FIG. 4C). From this position of the piston, the water has inside the piston (in the secondary chamber 72 created during the switching from FIGS. 4B to 4C by the displacement of the piston and represented in FIG. 4C), can no longer escape, which stops the retraction of the piston (it is thus in hydraulic abutment in its intermediate position). At the end of the shock-absorption phase (upstream of the second mechanical abutment), the pressure in the shock-absorbing circuit falls below the value defined by the pressure relief valves 28. At the beginning of the shock-absorption, the pressure in the cylinders and the hydraulic circuit is limited by the valves 28 which also limit the maximum deceleration seen by the module. When the module has sufficiently slowed down, the pressure in the cylinders drops and the valves 28 close, the end of the shock-absorption and the associated deceleration decrease from the pressure plate of the valves to drop to zero when the module has reached the desired constant speed, before the hydraulic abutment.

It is noted that the finger 64 may have at its free end a chamfer 64*a* in order to smooth the stop of the piston in the intermediate position. It will also be noted that the dimensioning of the restriction orifice 32 of the shock-absorbing circuit allows controlling the desired shock-absorption during this phase and controlling the final speed of impact of the piston before it stops in the intermediate position.

It should also be noted that after an impact, it is possible that due to the swell, the module will be raised again. In this case, it is necessary that the hydraulic system of the device is reset (i.e. that the pistons are redeployed) to absorb a new impact. To this end, as represented in FIG. 6, it may be provided to position a spring 74 around a guide rod 76 connecting the finger 64 to the piston 48, this spring allows assisting in the deployment of the piston. It will be noted that the guide rod 76 can be formed of two pierced and hollow rods and sliding one inside the other, namely a rod 76*a* fixed to the finger 64 and another rod 76*b* fixed to the piston 48.

Furthermore, the check valve 34 of the shock-absorbing circuit allows increasing the flow rate of water return in the circuit and therefore also assisting in the redeployment of the pistons by reducing the hydraulic pressure losses.

Once the module has completely landed on the base of the subsea processing station, the cable of the winch of the installation and maintenance boat is relaxed and the module is no longer linked to the movements of the boat. It is then in the intermediate position, the cylinders being in hydraulic abutment.

The remote operated vehicle then connects to the hydraulic system of the device to open the valve 40 of the controlled-lowering circuit while keeping the valve 30 of the shock-absorbing circuit 22 open (FIG. 4D). This action allows releasing the water contained in the secondary chamber 72 in order to control the final lowering of the module.

During this phase of controlling the lowering operation, the water present in the secondary chamber 72 is expelled towards the controlled-lowering circuit by taking the discharge duct 68 formed in the finger 64, while the water present in the first chamber 52 continues to be expelled towards the shock-absorbing circuit by taking the discharge ducts 66.

It will be noted that the restriction orifice 42 of the controlled-lowering circuit allows controlling the exhaust flow rate and therefore the speed of lowering of the module. The final height position of the module is determined by the abutments of the connectors and of the module itself. The total length of the cylinder can therefore be designed so that the second mechanical abutment defined by the upper bearing surface 62 "arrives" after the abutment of the connectors upon lowering of the module into the final position.

It will also be noted that once the module has reached the final position, the remote operated vehicle can close the connectors between the module and the base of the device. It then performs tests of verification of sealing of the connectors. In the event of a poor sealing, it can intervene directly on these connectors to change the seals, for example. For this purpose, it suffices that the remote operated vehicle closes the two valves 30 and 40 of the hydraulic circuits 22 and 24, connects to the exhaust 26 of the hydraulic circuits 22, 24 and pumps the water in these circuits to deploy the pistons of the cylinders and thus raise the module in the high position. The pumped water passing through the check valves of the two circuits, and just like the valves 30, 40 are closed, the module remains in the high position even when the remote operated vehicle stops pumping water. In this way, a remote operated vehicle allows maneuvering the module and changing the seals of the connectors. Once the maintenance intervention is completed, the remote operated vehicle returns to open the valves of the hydraulic circuits and the module lowers again to the low position.

It will also be noted that once the module has been installed and is in the final position on the base of the subsea processing station, and that the tests have shown that there was no need for additional intervention on the connectors, the device can be retrieved. For this purpose, the valve 40 of the controlled-lowering circuit is closed, then the mechanical connections between the device and the module are open (it can be hydraulic cylinders which release the lifting lugs for example, actuated by the ROV). The device is thus no longer connected to the module. The installation and maintenance boat can then rewind the cable from its winch and the device can be retrieved on the surface while the module remains in place on the base of the station.

Finally, it will be noted that once the device has been retrieved on the surface, the method may further comprise a phase of retrieving the module on the surface with the device retrieved on the surface. This retrieving phase comprises the successive steps of lowering the device under water from the surface by the installation and handling boat, up to the module, of mechanically fixing the device to the module, of closing the valve of the controlled-lowering circuit, of pumping the fluid to inject it into the shock-absorbing and controlled-lowering circuits to deploy the respective pistons of the hydraulic cylinders of the device and raise the module in the intermediate position, on the hydraulic abutment, and of retrieving the module and the device using the winch of the installation and maintenance boat.

The invention claimed is:

1. A device for installing and handling a module of a subsea processing station, comprising a frame intended to be fixed to a module, and a hydraulic system intended to ensure a shock-absorption and a controlled-lowering of the module on a base of the station, the hydraulic system comprising a plurality of hydraulic cylinders each intended to be connected to a foot able to come into contact with a base of the subsea processing station, each hydraulic cylinder comprising:

a cylinder body secured to the frame; and a piston intended to be put into contact with a foot and movable in translation inside the cylinder body between a first mechanical abutment corresponding to a deployed position of the piston and a second mechanical abutment corresponding to a retracted position of the piston, the piston dividing the internal volume of the cylinder body into a first chamber and a second chamber which are sealed relative to each other;

the first chamber of each hydraulic cylinder being supplied with hydraulic fluid by two independent hydraulic circuits comprising a shock-absorbing circuit able to move the piston between its deployed position and an intermediate position located between the deployed position and the retracted position and defined by a hydraulic abutment, and a controlled-lowering circuit able to move the piston between the intermediate position and its retracted position.

2. The device according to claim 1, wherein the piston of each hydraulic cylinder has, at one end located inside the body of the cylinder, an opening communicating with the first chamber and a flange coming into sealed contact with an inner wall of the body of the cylinder.

3. The device according to claim 2, wherein the cylinder body of each hydraulic cylinder is equipped with a finger protruding inside the first chamber, the finger having an external diameter corresponding substantially to the internal diameter of the piston so to cooperate with the opening of the piston to form the hydraulic abutment corresponding to the intermediate position of the piston.

4. The device according to claim 3, wherein the finger comprises a discharge duct of the hydraulic controlled-lowering circuit which opens out inside the piston when the latter is in the intermediate position so as to allow moving the piston between the intermediate position and the retracted position.

5. The device according to claim 2, wherein the inside of the cylinder body of each hydraulic cylinder comprises bearing surfaces against which the flange of the piston is able to come into contact to form the first and the second mechanical abutment.

6. The device according to claim 3, wherein each hydraulic cylinder further comprises a guide rod connecting the finger to the piston and a spring mounted around the guide rod to assist in the deployment of the piston.

7. The device according to claim 1, wherein the second chamber of each hydraulic cylinder is supplied with hydraulic fluid by a hydraulic raising circuit.

8. The device according to claim 7, wherein the hydraulic raising circuit of each hydraulic cylinder comprises grooves formed in an outer wall of the piston which open outside the device and open out into the second chamber.

9. The device according to claim 1, wherein the shock-absorbing and controlled-lowering circuits each comprise:

a valve which is able to be piloted by a remote operated vehicle from a surface; and a check valve in parallel with the valve to allow increasing the incoming fluid flow rate upon deployment of the cylinders.

10. The device according to claim 1, wherein the shock-absorbing and controlled-lowering circuits each comprise at least one pressure relief valve downstream of the hydraulic cylinders.

11. The device according to claim 1, wherein the shock-absorbing and controlled-lowering circuits are supplied with seawater.

12. A method for installing and handling a module of a subsea processing station, wherein the frame of a device according to claim 1 is attached to a module, the method comprising, during the phases of lowering and landing the module on a base of the subsea processing station, the steps of:

deploying the respective pistons of the hydraulic cylinders of the device, opening the shock-absorbing circuit and closing the controlled-lowering circuit to absorb the impacts of the module on the base of the station; and once the module has landed on the base of the station, opening the controlled-lowering circuit by keeping the shock-absorbing circuit open to allow the final lowering of the module at controlled speed on the base of the station.

13. The method according to claim 12, further comprising, during a phase of lifting the module, a step of pumping the fluid to inject it into the shock-absorbing and controlled-lowering circuits to deploy the respective pistons of the hydraulic cylinders of the device.

14. The method according to claim 12, further comprising, during a phase of retrieving the device on a surface after installation of the module on the base of the subsea processing station, the closing of the controlled-lowering circuit and the opening of mechanical connections between the device and the module in order to lift the device on the surface using a winch from an installation and maintenance boat.

15. The method according to claim 14, further comprising a phase of retrieving the module on the surface with the device retrieved on the surface, the retrieval phase comprising the steps of:

lowering the device under water from the surface by the installation and maintenance boat, to the module;

mechanically fixing the device to the module;

closing a valve of the controlled-lowering circuit;

pumping the fluid to inject it into the shock-absorbing and controlled-lowering circuits to deploy the respective pistons of the hydraulic cylinders of the device and raise the module in the intermediate position, on the hydraulic abutment; and retrieving the module and the device using the winch of the installation and maintenance boat.

* * * * *